US011821681B2

(12) United States Patent
Cleland et al.

(10) Patent No.: US 11,821,681 B2
(45) Date of Patent: Nov. 21, 2023

(54) COOLING LINE WITH COLD PLATE AND RECIRCULATING OF DISPENSED FLUID

(71) Applicant: Cleland Sales Corporation, Los Angeles, CA (US)

(72) Inventors: James Cleland, Cypress, CA (US); Adam Cleland, Los Alamitos, CA (US)

(73) Assignee: Cleland Sales Corporation, Los Alamitos, CA (US)

( * ) Notice: Subject to any disclaimer, the term of this patent is extended or adjusted under 35 U.S.C. 154(b) by 319 days.

(21) Appl. No.: 16/858,554

(22) Filed: Apr. 24, 2020

(65) Prior Publication Data

US 2021/0333046 A1 Oct. 28, 2021

(51) Int. Cl.

| | |
|---|---|
| ***F25D 31/00*** | (2006.01) |
| ***F25D 15/00*** | (2006.01) |
| ***F25D 17/02*** | (2006.01) |
| ***B67D 3/00*** | (2006.01) |
| ***F25D 25/04*** | (2006.01) |
| ***F25D 29/00*** | (2006.01) |
| ***F25D 23/00*** | (2006.01) |

(52) U.S. Cl.

CPC ..... *F25D 31/007* (2013.01); *B67D 3/0009* (2013.01); *F25D 15/00* (2013.01); *F25D 17/02* (2013.01); *F25D 23/003* (2013.01); *F25D 25/04* (2013.01); *F25D 29/005* (2013.01)

(58) Field of Classification Search

CPC ..... F25D 31/007; F25D 31/002; F25D 15/00; F25D 17/025; F25D 23/003; F25D 25/04; F25D 29/005; B67D 3/009

See application file for complete search history.

(56) References Cited

U.S. PATENT DOCUMENTS

| | | | | |
|---|---|---|---|---|
| 5,115,942 | A * | 5/1992 | Merrill | B67D 1/0857 222/146.6 |
| 5,996,842 | A * | 12/1999 | Riley | B67D 1/0867 62/332 |
| 9,243,830 | B2 | 1/2016 | Chadwell et al. | |
| 2011/0084096 | A1* | 4/2011 | Schroeder | B67D 1/0086 222/144.5 |
| 2017/0138663 | A1 | 5/2017 | Wells | |
| 2017/0190561 | A1* | 7/2017 | Cleland | F25B 47/022 |
| 2020/0109042 | A1* | 4/2020 | Jacobsen | B67D 1/0888 |
| 2020/0370816 | A1* | 11/2020 | Nooli | F25D 21/008 |

* cited by examiner

*Primary Examiner* — Elizabeth J Martin

(74) *Attorney, Agent, or Firm* — Fish IP Law, LLP

(57) ABSTRACT

Apparatus, systems, and methods for cooling fluids, for example beverages or beverage components, are presented. A cooling system or device includes a cold plate of bulk material (e.g., material of high thermal conductivity). A first sensor (preferably temperature sensor) is positioned within the bulk material and communicatively coupled to a processor. A first fluid line is at least partially disposed within the cold plate, having a first inlet entering and a first outlet exiting the cold plate. A second sensor (preferably temperature sensor) is positioned at the first fluid line proximal to the first outlet and communicatively coupled to the processor. The processor compares a sensor reading from the first sensor with a sensor reading from the second sensor, and issues an error report when the difference between the readings is above a threshold, or an individual reading from a sensor is outside of an operational parameter.

18 Claims, 3 Drawing Sheets

COOLING LINE WITH COLD PLATE AND RECIRCULATING OF DISPENSED FLUID

FIELD OF THE INVENTION

The field of the invention is liquid cooling systems and devices.

BACKGROUND

The background description includes information that may be useful in understanding the present invention. It is not an admission that any of the information provided herein is prior art or relevant to the presently claimed invention, or that any publication specifically or implicitly referenced is prior art.

Providing cooled beverages has long been a primary challenge and goal of restaurants, convenience stores, and bars, from the most bare-bones establishments to those of the highest caliber. With such universal demand to cool beverages, many solutions have been developed to monitor the cooling of beverages, for example focusing on maintaining a cold plate at optimum cooling conditions. For example, U.S. Pat. No. 5,996,842 to Riley et al., teaches a cooling system with a temperature sensor in a cold plate that triggers coolant to bypass the cold plate when the sensor is below target temperature.

All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Likewise, U.S. Pat. No. 9,243,830 to Cleland teaches a cold plate with a thermistor at the coolant outlet line from the cold plate to monitor cold plate temperature. Similarly, U.S. 2017/0138663 to Wells teaches placing a temperature sensor on a coolant line exiting a beverage python, in conjunction with an air temperature sensor and a temperature sensor on a coolant line that exits condenser heading toward python, in order to control and optimize coolant temperature in view of cooled beverage temperature. However, each of these solutions fail to account for problems that can develop within a cold plate during operation, for example coolant freezing, obstructions in the coolant line within the cold plate, or sensor errors that fail to account for differences between cold plate temperature and temperature of the coolant, either exiting, entering, or while passing through a cold plate.

Thus, there is still a need for methods, systems, and devices to efficiently cool beverages and identify or otherwise prevent operation errors or inefficiencies of a cold plate beverage cooling system.

SUMMARY OF THE INVENTION

The inventive subject matter provides apparatus, systems and methods for cooling fluids, for example beverages or beverage components. A cooling system or device includes a cold plate made of a bulk material, for example a material of high thermal conductivity (e.g., steel or greater, aluminum or greater, copper or greater, carbon constructs or greater, combinations or alloys of such materials, etc.). A first sensor is positioned within the bulk material and communicatively coupled to a processor (e.g., wired, wireless, etc.). A first fluid line is at least partially disposed within the cold plate, having a first inlet entering and a first outlet exiting the cold plate.

A second sensor is positioned at the first fluid line (e.g., at least a portion is suspended in a flow of the fluid, on an interior wall of the fluid line, in the wall of the fluid line, on the exterior of the fluid line, combination thereof, etc.) proximal to the first outlet (e.g., immediately adjacent, within 1 inch, 3 inches, 5 inches, etc.) and communicatively coupled to the processor. It is also contemplated that the second sensor or additional sensors be positioned at (or proximal to) the first fluid inlet or at a portion of the first fluid line disposed within the cold plate. In preferred embodiments, the first and second sensors are temperature sensors (e.g., thermistor, etc.).

In some embodiments, the first sensor is removably disposed within a recess in the bulk material. For example, in some embodiments the bulk material includes a column or channel accessible from outside the cold plate that extends near a center of the bulk material (e.g., center of mass, point in central plane of bulk material, point in central plane of bulk material proximal the first outlet, etc.). The first sensor is then inserted or removed from the column as may be desired to detect parameters of the cold plate, preferably temperature of the cold plate near the center of the bulk material that approximates the core temperature of the cold plate.

However, additional sensors can further be positioned on other or additional points of the bulk material, whether reversibly placed via other columns, affixed to an exterior surface of the cold plate, or otherwise embedded in the bulk material. It is contemplated that use of additional sensors dispersed within or about the bulk material favorably provides a broader view of one or more parameters of the cold plate. For example, where multiple temperature sensors are used a 3D heat map of the cold plate can be approximated and used to identify problems with the cold plate or the first fluid line. Disparate temperature regions of the cold plate cold indicate poor insulation, a clog or obstruction in the first fluid line, or an errant heat source or heat sink. It is also contemplated that thermal imaging devices be used to monitor temperature of various components of cooling devices and systems of the inventive subject matter, in combination or as an alternative to one or more sensors.

The processor compares a sensor reading (e.g., temperature) from the first sensor with a sensor reading (e.g., temperature) from the second sensor. Such comparisons are favorably used to issue reports on the status of the cold plate or the cooling system. For example, when the processor determines the temperature reading from the first sensor is more than 5° C. different (higher or lower) than the temperature reading from the second sensor, the processor issues an error report to a user, either via an attached user interface or a communicatively coupled display (e.g., smart phone, smart watch, via text, via email, etc.). Alternatively or in combination, the processor issues an error report when the reading from one sensor is outside of an operational parameter, for example the temperature reading from the first sensor is less than a freezing point of a coolant in the first fluid line.

The first fluid line typically carries a first coolant, for example water, glycol, or combinations thereof, circulating the first coolant from the first outlet of the cold plate, to a condenser, and then to the first inlet of the cold plate. In some embodiments a second fluid line is disposed in the cold plate with a second inlet entering and a second outlet exiting the cold plate. The second fluid line carries a second coolant in dual coolant embodiments, but the second fluid line alternatively carries a beverage ingredient or complete beverage, for example water, soda water, beer, wine, liquor, mixed drinks, or fruit juice. For embodiments with a second fluid line, a third sensor is typically positioned at the second outlet of the second fluid line, wherein the third sensor is a temperature sensor.

Customizable cooling systems and devices are further contemplated. A cold plate substantially composed of a bulk material has a channel accessing a cavity within the bulk material, the channel sized and dimensioned to receive or otherwise provide access for positioning a sensor probe in the cavity. A first fluid line preferably carrying a coolant is disposed within the cold plate, with a first inlet entering and a first outlet exiting the cold plate. A first sensor, preferably a temperature sensor, is positioned at the first fluid line proximal to the first outlet (e.g., suspended in the fluid, on an interior wall of the line, in the wall of the line, on the exterior of the line, etc.) and communicatively coupled to a processor.

It is further contemplated that a sensor probe is removably disposed within the cavity and communicatively coupled to the processor. The sensor probe is a typically temperature sensor probe. The processor is configured to compare a temperature reading from the first sensor and a reading from the sensor probe, preferably both temperature readings, and issue a report on the status of the cooling device, for example an error report. For example, the processor is configured to report an error when a temperature reading from the first sensor is more than 5° C. different (higher or lower) than a reading from the sensor probe, or where the reading from the sensor probe corresponds with a temperature below (e.g., 1° C., 2° C., 3° C., or more than 5° C. below, etc.) a freezing point of the coolant or fluid in the first fluid line.

Various objects, features, aspects and advantages of the inventive subject matter will become more apparent from the following detailed description of preferred embodiments, along with the accompanying drawing figures in which like numerals represent like components.

DETAILED DESCRIPTION

The inventive subject matter provides apparatus, systems and methods for cooling fluids, for example beverages or beverage components. A cooling system or device includes a cold plate made of a bulk material, for example a material of high thermal conductivity (e.g., steel or greater, aluminum or greater, copper or greater, carbon constructs or greater, combinations or alloys of such materials, etc.). A first sensor is positioned within the bulk material and communicatively coupled to a processor (e.g., wired, wireless, etc.). A first fluid line is at least partially disposed within the cold plate, having a first inlet entering and a first outlet exiting the cold plate.

Customizable cooling systems and devices are further contemplated. A cold plate substantially composed of a bulk material has a channel accessing a cavity within the bulk material, the channel sized and dimensioned to receive or otherwise provide access for positioning a sensor probe in the cavity. A first fluid line preferably carrying a coolant is disposed within the cold plate, with a first inlet entering and a first outlet exiting the cold plate. A first sensor, preferably a temperature sensor, is positioned at the first fluid line proximal to the first outlet (e.g., suspended in the fluid, on an interior wall of the line, in the wall of the line, on the exterior of the line, etc.) and communicatively coupled to a processor.

Figure 1:
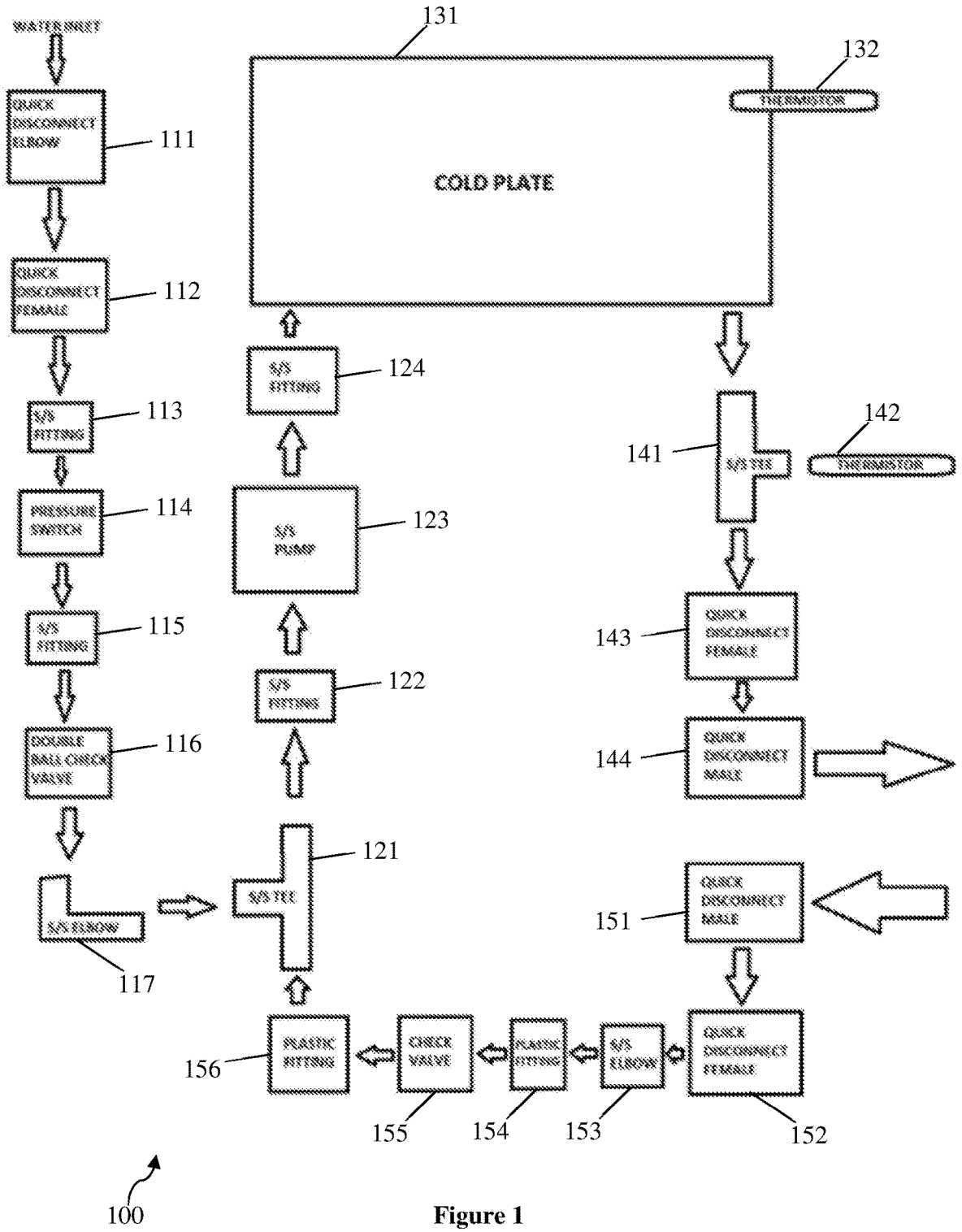
FIG. 1 depicts a schematic of a system of the inventive subject matter.

FIG. 1 depicts a schematic 100 of a system of the inventive subject matter. In general a fluid (e.g., water, coolant, water/coolant mix, etc.) is circulated through the system of schematic 100. The fluid (e.g., water) enters the system at quick disconnect elbow 111, and passes through quick disconnect female 112, stainless steel fitting 113, pressure switch 114, stainless steel fitting 115, double ball check valve 116, to stainless steel elbow 117. Typically when there is a low/negative pressure condition downstream from pressure switch 114, switch 114 opens to allow fluid to pass to stainless steel 121 into circulation with cold plate 131. When a pressure condition downstream of pressure switch 114 is equal or greater to pressure upstream of switch 114, switch 114 closes and no additional fluid passes into the system.

Stainless steel elbow 117 passes fluid into an inlet of stainless steel tee 121 and through stainless steel fitting 122, stainless steel pump 123, stainless steel fitting 124, and into cold plate 131. In some embodiments, cold plate 131 cools (e.g., below room temperature, near STP freezing of water, etc.) the fluid (e.g., water), and passes cooled fluid into stainless steel tee 141. It is also contemplated that the fluid can be used to cool cold plate 131 to a desired temperature, for example by a condenser positioned upstream of cold plate 131 (e.g., between stainless steel pump 123 and cold plate 131, between stainless steel pump 123 and stainless steel tee 121, etc.). Fluid is passed from cold plate 131 to stainless steel tee 141 and through quick disconnect female 143, quick disconnect male 144, and to downstream elements of the system (e.g., distribution of fluid, mixing of the fluid, conditioning of the fluid, etc.).

After fluid passes through elements of the system downstream from quick disconnect male 144, any remaining fluid is then recirculated back toward cold plate 131 portion of the system by quick disconnect male 151 through quick disconnect female 152, stainless steel elbow 153, plastic fitting 154, check valve 155, plastic fitting 156, and into stainless steel tee 121 and circulates fluid to cold plate 131. In some embodiments, all (or most) fluid passing from quick disconnect male 144 to downstream system components is returned to quick disconnect female 152, permitting the fluid to circulate back to cold plate 131. In such embodiments, a low/negative pressure condition does not build downstream of pressure switch 114, and switch 114 is closed and no addition fluid enters the system into circulation with cold plate 131. In embodiments where some or all of the fluid passing from quick disconnect male 144 to downstream system components is used or otherwise removed (e.g., purged) from the system, a low/negative pressure condition builds downstream of pressure switch 114, switch 114 opens, and additional fluid enters the system in circulation with cold plate 131.

Schematic 100 of the system also includes thermistor 132 in thermal communication with cold plate 131 and thermistor 142 in thermal communication with stainless steel tee 141. Thermistors 132 and 142 detect temperature conditions at cold plate 131 and stainless steel tee 141, respectively, and are typically informationally coupled (e.g., wireless, wired, etc.) with a processor (not depicted). In embodiments where the fluid is cooled by the cold plate (e.g., the fluid is water to be distributed as beverage or part thereof), thermistor 132 reports temperature of cold plate 131 and thermistor 142 reports temperature of stainless steel tee 141, indirectly reporting temperature of the fluid exiting cold plate 131 (or directly reporting the temperature where thermistor 142 is in direct communication with the fluid). In such embodiments, a comparison of temperatures reported by thermistors 132 and 142 are used to assess the effectiveness of cold plate 131 in cooling the fluid. For example, where thermistor 132 reports a temperature higher than thermistor 142, an error report is generated indicating a failure of thermistor 132 or other error in cold plate 131. Likewise, where thermistor 132 reports a temperature much less than thermistor 142, an error is generated indicating insufficient cooling of the fluid, or the system is otherwise modified (e.g., cold plate temperature lowered) to improve cooling of the fluid exiting cold plate 131.

Figure 2:
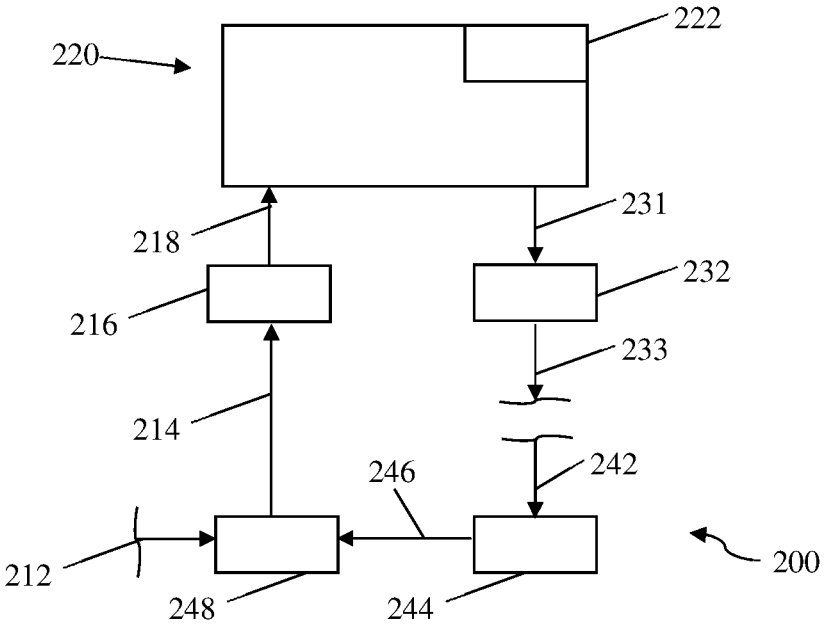
FIG. 2 depicts a schematic of another system of the inventive subject matter.

FIG. 2 depicts schematic 200 of another system of the inventive subject matter. Schematic 200 depicts the circulation of a fluid (e.g., water, coolant, beer, juice, mixed beverage, beverage ingredient, etc.) through cold plate 220. The fluid enters circulation with cold plate 220 through fluid line 212. Fluid line 212 directs the fluid into an inlet of component 248 (e.g., T-line, T-valve, etc.). The fluid is then directed through fluid line 214 into component 216. Where the fluid is a beverage or a beverage ingredient, component 216 is typically a pump used to drive the fluid into cold plate 220 to cool the fluid, and through the system. Where the fluid is a coolant used to cool cold plate 220 to a maintain a desired temperature, component 216 is a condenser used to condense the coolant before coolant is delivered to cold plate 220. Component 216 can alternatively be, or further comprise, a thermistor in thermal communication with the fluid.

Fluid line 218 carries the fluid from component 216 and into cold plate 220. Cold plate 220 used to cool a beverage or beverage ingredient to a desired temperature. In some embodiments, the fluid delivered to the cold plate by fluid line 218 is a beverage or beverage ingredient to be cooled by cold plate 220, while in other embodiments the fluid is a coolant used to cool cold plate 220. Cold plate 220 also includes thermistor 222. In some embodiments, thermistor 222 is in thermal communication with the fluid and detects temperature of the fluid as it passes through cold plate 220. Thermistor 222 can alternatively, or additionally, be in thermal communication with a bulk element of cold plate 220 (e.g., aluminum body of cold plate, etc.), and used to detect the temperature of cold plate 220.

After passing through cold plate 220 the fluid passes through fluid line 231 and into component 232. Component 232 includes a thermistor in thermal communication with the fluid, which detects the temperature of the fluid as it exits cold plate 220. Such an arrangement permits monitoring and comparison of the temperature of cold plate 220 (or fluid resident in cold plate 220) and fluid exiting cold plate 220. Where the temperature reported by thermistor 222 and component 232 differ beyond a tolerance (e.g., 3%, more than 4%, 5%, 6%, 7%, 8%, 9%, or 10% different, or 3° C., more than 4° C., 5° C., 6° C., 7° C., or 8° C. different). Similarly, where component 232 reports a temperature lower (e.g., more than 2° C. lower, etc.) than thermistor 222, an error report indicates a problem with thermistor 222 or cold plate 220.

The fluid then passes from component 232 into fluid line 233 toward downstream components of the system, which can include mixing, conditioning, or distribution components where the fluid is a beverage or beverage ingredient, or can include conditioning or purging components where the fluid is a coolant recirculated for cooling cold plate 220. The fluid is then passed from downstream components through fluid line 242 into component 244, to fluid line 246, and to component 248. Component 248 directs the fluid back toward cold plate 220.

Figure 3:
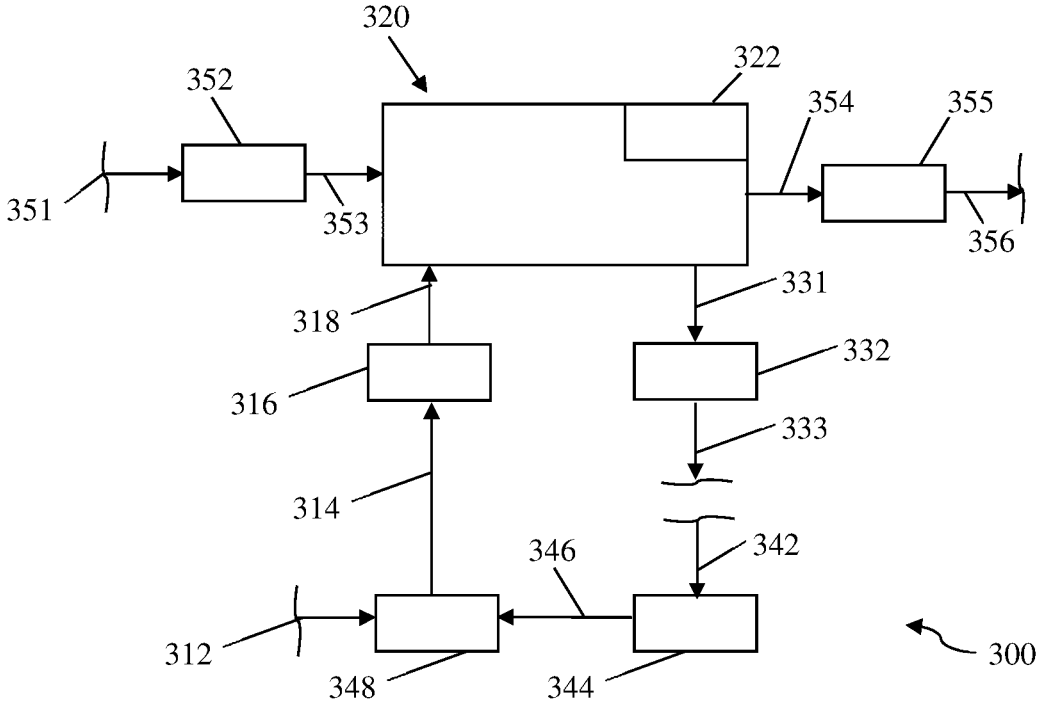
FIG. 3 depicts a schematic of yet another system of the inventive subject matter.

FIG. 3 depicts schematic 300 of another system of the inventive subject matter. Schematic 300 depicts the circulation of a first fluid (e.g., water, coolant, beer, juice, mixed beverage, beverage ingredient, etc.) through fluid lines 312, 314, 318, 331, 333, 342, and 346 and through cold plate 320. A second fluid (e.g., water, coolant, beer, juice, mixed beverage, beverage ingredient, etc.) is circulated through lines 351, 353, 354, and 356, and through cold plate 320. Fluid lines 312, 314, 318, 331, 333, 342, and 346, and components 316, 332, 344, and 348 are as described above with respect to similarly numbered components. In preferred embodiments, where the first fluid is a coolant, the second fluid is a beverage or a beverage ingredient, and vice versa. It is also contemplated that both the first fluid and the second fluid are coolants, for example maintained at different temperatures to dynamically control the temperature of cold plate 320.

The second fluid passes through fluid line 351 to component 352, and through fluid line 353 to cold plate 320. In some embodiments component 352 includes a pump to drive the second fluid through fluid lines 351, 353, 354, and 356, components 352 and 355, and through cold plate 320. Component 352 can further, or alternatively, include a condenser (for example to condense a coolant before the coolant enters cold plate 320) or a thermistor (for example to detect temperature of the second fluid before entering cold plate 320). The second fluid passes through cold plate 320, through fluid line 354 to component 355, and then to fluid line 356. Fluid line 356 passes the second fluid line to downstream system components, and typically back to fluid line 351 to recirculate the second fluid to cold plate 320.

Cold plate 320 includes thermistor 322. Thermistor 322 is typically in thermal communication with a bulk material of cold plate 320 (e.g., aluminum body of cold plate) and is used to detect or monitor temperature of cold plate 320. In some embodiments, thermistor 322 is further, or alternatively, in thermal communication with the first fluid, the second fluid, or a combination thereof. Component 355 preferably includes a thermistor and is used to detect and monitor temperature of the second fluid exiting cold plate 320. Viewed from another perspective, in some embodiments the temperature of the first fluid entering, exiting, and resident in the cold plate, the temperature of the second fluid entering, exiting, and resident in the cold plate, or partial combinations thereof, is monitored and compared to identify temperature variances between the various locations to indicate a problem in the system or otherwise assess performance.

For example, where the second fluid is a coolant and the first fluid is a beverage or beverage ingredient, a temperature at component 355 higher (e.g., 3%, more than 4%, 5%, 6%, 7%, 8%, 9%, or 10% higher, or 5° C., more than 6° C., 7° C., 8° C., 9° C., or 10° C. higher) than a temperature at thermistor 322 or component 352 may indicate a blockage in the coolant line in cold plate 320, particularly where the temperature of thermistor 322 and component 352 are relatively equivalent (e.g., within 1%, 2%, etc.). Similarly, if temperature at component 332 is higher than temperature at thermistor 322, it may indicate beverage or beverage ingredient resident in cold plate 320 is frozen or otherwise blocked.

In systems where both first and second fluids are coolants at different temperatures, thermistor 322 can be monitored to increase or decrease flow of first or second fluid through cold plate 320, for example to increase, decrease, or stabilize the temperature in cold plate 320. Likewise, where first and second fluids are each a beverage or beverage ingredient, flow of each fluid through cold plate 320 can be increased or decreased to allow for longer residency of each fluid in the cold plate as required to achieve a desired fluid temperature, with increased residency bringing fluid temperature closer to the temperature of cold plate 320.

Figure 4:
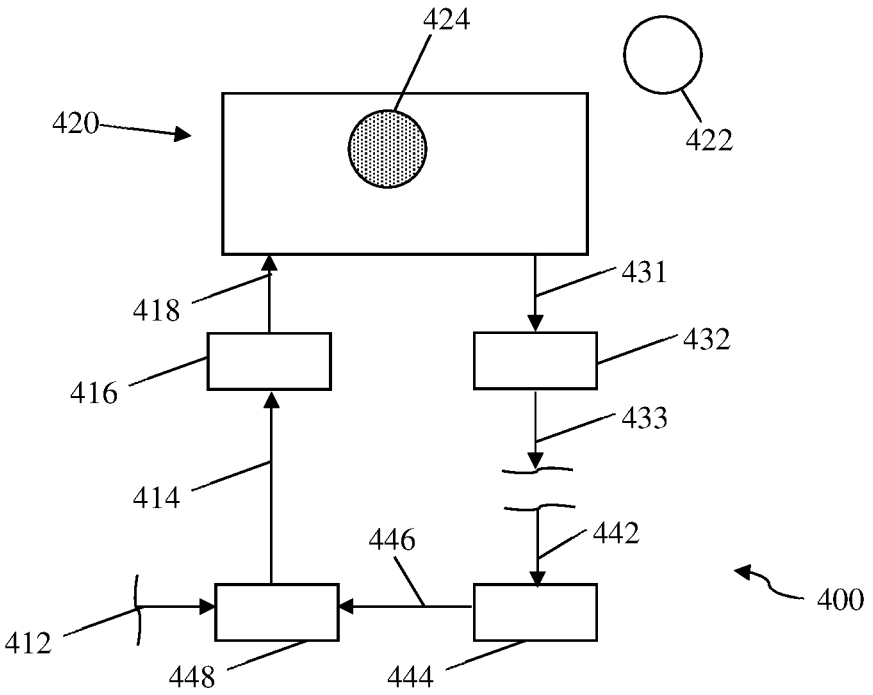
FIG. 4 depicts a schematic of still another system of the inventive subject matter.
Figure 5:
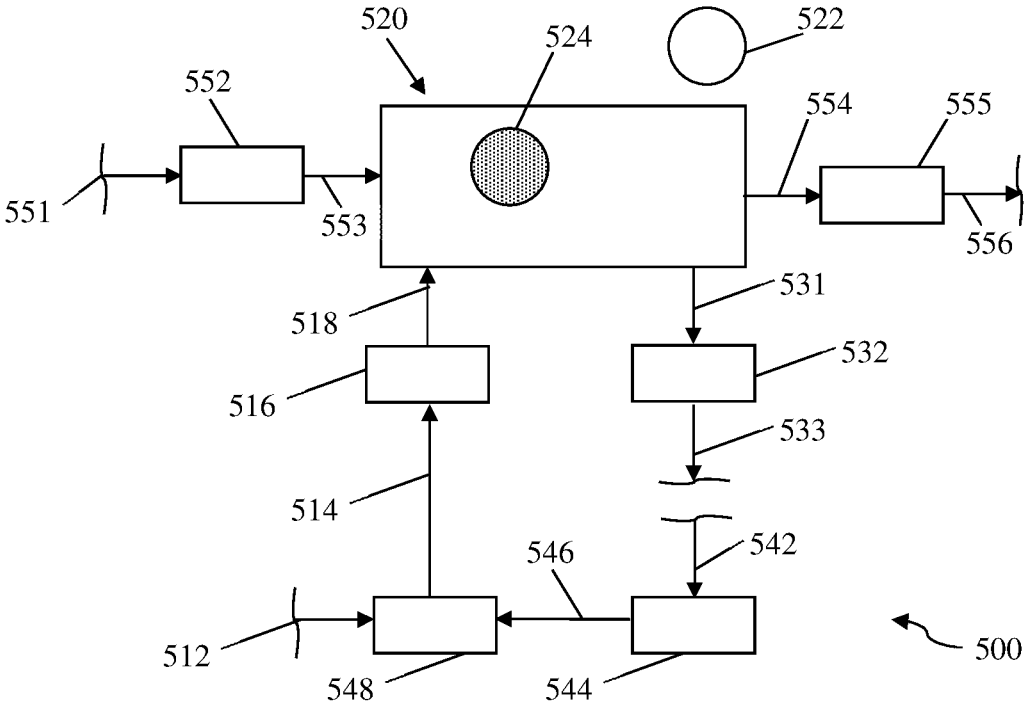
FIG. 5 depicts a schematic of a further system of the inventive subject matter.

FIGS. 4 and 5 each depict schematics 400 and 500 of systems of the inventive subject matter, similar to FIGS. 2 and 3. Schematics 400 and 500 differ in that thermistors 422 and 522 are removable from cold plates 420 and 520, respectively. As such, elements 412, 414, 416, 418, 420, 422, 432, 433, 442, 444, 446, and 448 of FIG. 4 are as otherwise described by elements 212, 214, 216, 218, 220, 222, 232, 233, 242, 244, 246, and 248 of FIG. 2, respectively. Likewise, elements 512, 514, 516, 518, 520, 522, 532, 533, 542, 544, 546, 548, 551, 552, 553, 554, 555, and 556 of FIG. 5 are as otherwise described by elements 312, 314, 316, 318, 320, 322, 332, 333, 342, 344, 346, 348, 351, 352, 353, 354, 355, and 356 of FIG. 3, respectively. In each instance, cavities or bores 424 and 524 provide access for thermistors 422 and 524 to be in thermal communication with the internal bulk material of cold plates 420 and 520, with first or second fluids resident in cold plates 420 or 520, or combinations thereof.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

The following description includes information that may be useful in understanding the present invention. It is not an admission that any of the information provided herein is prior art or relevant to the presently claimed invention, or that any publication specifically or implicitly referenced is prior art.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A cooling system comprising:

a cold plate comprising a bulk material;

a first temperature sensor positioned within the bulk material to sense a temperature of the cold plate;

a fluid line comprising an inlet entering the cold plate and an outlet exiting the cold plate, wherein the fluid line carries a fluid that is at least part of a beverage, and wherein the fluid line forms a closed loop between the inlet and the outlet;

a second temperature sensor positioned proximal to the outlet to sense a temperature of the fluid;

wherein the first and second temperature sensors are communicatively coupled to a processor; and wherein the processor compares a temperature reading from the first temperature sensor with a temperature reading from the second temperature sensor to assess the effectiveness of the cold plate in cooling the fluid.

2. The cooling system of claim 1, wherein a portion of the second temperature sensor is disposed within the fluid line to directly sense the temperature of the fluid.

3. The cooling system of claim 1, further comprising a tee coupled to the fluid line, wherein the second temperature sensor is in thermal communication with the tee, and wherein the second temperature sensor indirectly senses the temperature of the fluid by sensing a temperature of the tee.

4. The cooling system of claim 3, wherein the tee is a stainless steel tee.

5. The cooling system of claim 1, wherein the first temperature sensor is removably disposed within a recess in the bulk material.

6. The cooling system of claim 1, wherein the first temperature sensor is embedded in the bulk material.

7. The cooling system of claim 1, wherein the fluid is the beverage.

8. The cooling system of claim 1, wherein the fluid line circulates at least part of the fluid from the outlet of the cold plate, to a dispenser, to the inlet of the cold plate.

9. The cooling system of claim 1, wherein the processor generates an error report when the temperature reading from the first temperature sensor is more than 5° C. higher than the temperature reading from the second temperature sensor.

10. The cooling system of claim 1, wherein the processor generates an error report when the temperature reading from the first temperature sensor is higher than the temperature reading from the second temperature sensor.

11. The cooling system of claim 1, wherein the processor generates an error report when the temperature reading from the first temperature sensor is more than 5° C. lower than the temperature reading from the second temperature sensor.

12. The cooling system of claim 1, further comprising a second fluid line comprising a second inlet entering the cold plate and a second outlet exiting the cold plate.

13. The cooling system of claim 12, wherein the second fluid line carries a second coolant.

14. The cooling system of claim 12, wherein the second fluid line carries a beverage ingredient selected from the group consisting of water, soda water, beer, wine, or fruit juice.

15. The cooling system of claim 12, further comprising a third temperature sensor at the second outlet of the second fluid line.

16. The cooling system of claim 1, wherein the fluid line recirculates at least some of the fluid exiting the outlet back to the inlet.

17. The cooling system of claim 1, wherein at least part of the fluid is dispensed as a beverage downstream of the second temperature sensor.

18. The cooling system of claim 1, wherein the fluid line receives the fluid from a source external to the closed loop.

* * * * *